US010405591B2

(12) United States Patent
Murphy et al.

(10) Patent No.: US 10,405,591 B2
(45) Date of Patent: Sep. 10, 2019

(54) MAGNETIC MASK

(71) Applicant: Seirus Innovative Accessories, Inc., Poway, CA (US)

(72) Inventors: Robert Murphy, San Diego, CA (US); Li-Ray Chen, San Diego, CA (US)

(73) Assignee: SERIUS INNOVATIVE ACCESSORIES, INC., Poway, CA (US)

( * ) Notice: Subject to any disclaimer, the term of this patent is extended or adjusted under 35 U.S.C. 154(b) by 423 days.

(21) Appl. No.: 14/995,066

(22) Filed: Jan. 13, 2016

(65) Prior Publication Data

US 2017/0196280 A1 Jul. 13, 2017

(51) Int. Cl.
*A41D 13/11* (2006.01)
*A42B 1/04* (2006.01)
*A41F 1/00* (2006.01)

(52) U.S. Cl.
CPC ..... *A41D 13/1153* (2013.01); *A41D 13/1161* (2013.01); *A41F 1/002* (2013.01); *A42B 1/046* (2013.01)

(58) Field of Classification Search
CPC ..... A41D 13/1153; A41D 13/1161; A41D 23/00; A41D 2023/006; A41D 2200/20; A41F 1/002; A42B 1/046
USPC ..... 2/202, 206; 24/303
See application file for complete search history.

(56) References Cited

U.S. PATENT DOCUMENTS 3,102,314 A * 9/1963 Alderfer ..... A41F 1/002 24/303
3,161,932 A * 12/1964 Russell ..... A41F 1/002 24/303
3,768,100 A * 10/1973 Colman ..... A41D 13/1161 2/206
3,827,019 A * 7/1974 Serbu ..... A41F 1/002 135/117
4,197,618 A * 4/1980 Bourguignon ..... A41F 1/002 24/303
4,399,595 A * 8/1983 Yoon ..... A41F 1/002 24/303
5,577,271 A * 11/1996 Davis ..... A01K 55/00 2/10
5,704,068 A 1/1998 Martin et al.
5,845,340 A * 12/1998 Frislie ..... A41D 13/1153 2/202

(Continued)

FOREIGN PATENT DOCUMENTS

CA 2799530 A1 * 11/2011 ..... H01F 7/0215
DE 202014010717 U1 * 6/2016 ..... A44B 99/00

(Continued)

OTHER PUBLICATIONS

International Search Report and Written Opinion for related International Application No. PCT/US2017/13539, dated Apr. 10, 2017, in 10 pages.

*Primary Examiner* — Alissa L Hoey
(74) *Attorney, Agent, or Firm* — Procopio, Cory, Hargreaves & Savitch LLP

(57) ABSTRACT

A head garment having a base section and a face section is provided where the face section is both affixed to the base section and releasably extends over the face of the user to create a magnetic seal against the elements. The head garment may also include a magnetic fastener to position the face covering section when it is not extended over the face of the user.

9 Claims, 10 Drawing Sheets

(56) References Cited

U.S. PATENT DOCUMENTS 6,269,489 B1 * 8/2001 Heath ..... A42B 1/046 2/171.4
6,397,395 B1 * 6/2002 DeHart ..... A41D 3/005 2/173
7,028,345 B2 4/2006 Waldman
7,154,363 B2 * 12/2006 Hunts ..... H01F 7/0242 335/306
8,074,300 B1 * 12/2011 Molina ..... A42B 1/08 2/202
8,615,853 B2 * 12/2013 Rathbun ..... H01F 7/0252 24/3.1
9,521,873 B1 * 12/2016 Mignone ..... A41D 13/1161
9,763,510 B1 * 9/2017 Miner ..... A45F 5/02
2003/0230606 A1 * 12/2003 Devinie ..... A45F 5/00 224/183
2006/0112523 A1 * 6/2006 Deto ..... A41F 1/002 24/303
2006/0117470 A1 * 6/2006 Hofmann ..... A62B 17/006 2/457
2006/0130213 A1 6/2006 Mickle
2008/0066214 A1 * 3/2008 O'Hare ..... A41D 13/1153 2/172
2008/0256979 A1 * 10/2008 Okamura ..... A44C 5/2071 63/3.1
2009/0100560 A1 * 4/2009 Anderson ..... A42B 1/048 2/15
2009/0151049 A1 * 6/2009 Conrardy ..... A42B 1/067 2/206
2009/0178245 A1 * 7/2009 Albert ..... A41F 1/002 24/303
2009/0282597 A1 * 11/2009 Volgyesi ..... A01K 55/00 2/4
2013/0111710 A1 * 5/2013 Hunts ..... H01F 7/0242 24/303
2013/0152930 A1 * 6/2013 Votel ..... A61M 16/1075 128/204.17
2015/0113711 A1 4/2015 Kim
2015/0159425 A1 * 6/2015 Algar ..... E06B 7/28 52/202
2015/0245675 A1 * 9/2015 Chinquee ..... A41D 13/1184 2/424
2015/0327612 A1 * 11/2015 Bublitz ..... A41D 3/02 2/202
2016/0015099 A1 * 1/2016 Saladino ..... A41D 15/002 2/173
2016/0037868 A1 * 2/2016 Lambert ..... A45C 13/1069 24/303
2016/0125988 A1 * 5/2016 Lee ..... H01F 7/021 361/807
2016/0195117 A1 * 7/2016 Yeh ..... F16M 11/041 24/303
2017/0079343 A1 * 3/2017 Chen ..... A41D 13/11
2017/0156433 A1 * 6/2017 Chen ..... A41D 27/00
2017/0234340 A1 * 8/2017 Pensak ..... F16B 1/00 24/3.1
2017/0311666 A1 * 11/2017 Gladish ..... A41F 1/002

FOREIGN PATENT DOCUMENTS

EP 3135142 A1 * 3/2017 ..... A41F 1/002
WO WO 2015183798 A1 * 12/2015 ..... A41F 1/002

* cited by examiner

MAGNETIC MASK

BACKGROUND

Field of the Invention

The present invention generally relates to cold weather clothing and more particularly relates to a head garment having a removable face covering.

Related Art

In cold weather environments it is often desirable to wear a head garment in order to keep the head and body warm. One problem with conventional head garments is that when the user is active and generating body heat, head garments may cause the user to overheat. An additional problem with conventional head garments that cover the face of the user, is that such face coverings frustrate the ability of the user be heard and understood when the user is attempting to speak, or perform other activities such as eating, drinking, etc.

Solutions to these problems have been proposed and some conventional head garments therefore have detachable masks that can be removed in order to allow excess heat to escape and to allow the user to effectively communicate. Such conventional solutions suffer from the ability of the detachable mask portion becoming lost, thereby extremely reducing the effectiveness of the head garment in cold weather.

Additionally, such conventional solutions suffer from the difficulty of aligning and attaching each of the fasteners that join the mask to the head garment while the user is wearing other cold weather gear, such as gloves. This problem has been addressed by replacing the mechanical fasteners (e.g., snaps and buttons) with magnets. However, any of these types of fasteners create the additional problem of cold air and wind reaching the face of the user between the gaps in the fasteners, which also significantly reduces the effectiveness of the head garment in cold weather.

Therefore, what is needed is a head garment that overcomes these significant problems found in the conventional head garments as described above.

SUMMARY

To solve the problems described above, described herein is a head garment with a base section and a magnetically sealed face section that is both partially affixed to the base section and detachable from the base section. The head garment includes a base section that defines an internal opening for the face of the user, the internal opening having a perimeter with a lower edge and an upper edge. The perimeter of the internal opening has a first piping extending along at least a portion of the lower edge and defining a first elongated internal cavity. Inside the first elongated internal cavity is a first plurality of elongated magnets. Each magnet may have a length that is longer than the width of the first elongated internal cavity. Alternatively, the magnet length can be equal to or shorter than the width. The magnets in the first elongated internal cavity are arranged such that each magnet is magnetically attracted to each of its one or two adjacent magnets.

The head garment also has a face section with a perimeter edge having a lower edge and an upper edge. The perimeter of the face section has a second piping extending along at least a portion of the lower edge and defining a second elongated internal cavity. Inside the second elongated internal cavity is a second plurality of elongated magnets, each having a length that is longer than the width of the second elongated internal cavity. The magnets in the second elongated internal cavity are arranged such that each magnet is magnetically attracted to each of its one or two adjacent magnets.

The face section also having a portion of its perimeter edge affixed to a portion of the perimeter edge of the internal opening of the base section. The face section can be affixed by stitching or heat sealing or the like.

The magnets in the first and second piping are also arranged such that each magnet in the first piping is magnetically attracted to a corresponding magnet in the second piping. Accordingly, when the face section is brought into proximity with the base section, each magnet in the first piping magnetically attaches to its corresponding magnet in the second piping to magnetically seal the face section over the face of the user. When the user removes the mask by pulling apart the magnetic seal, the affixed portion of the perimeter edge retains the face section with the base section.

Other features and advantages of the present invention will become more readily apparent to those of ordinary skill in the art after reviewing the following detailed description and accompanying drawings.

BRIEF DESCRIPTION OF THE DRAWINGS

The structure and operation of the present invention will be understood from a review of the following detailed description and the accompanying drawings in which like reference numerals refer to like parts and in which.

DETAILED DESCRIPTION

Certain embodiments disclosed herein provide for a head garment that includes a face section that can be magnetically attached to a base section to provide magnetically sealed protection of the user's face from the elements. The face section can alternatively be detached to allow the user's face to cool down and also allow the user to verbally communicate in an effective fashion. After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1A:
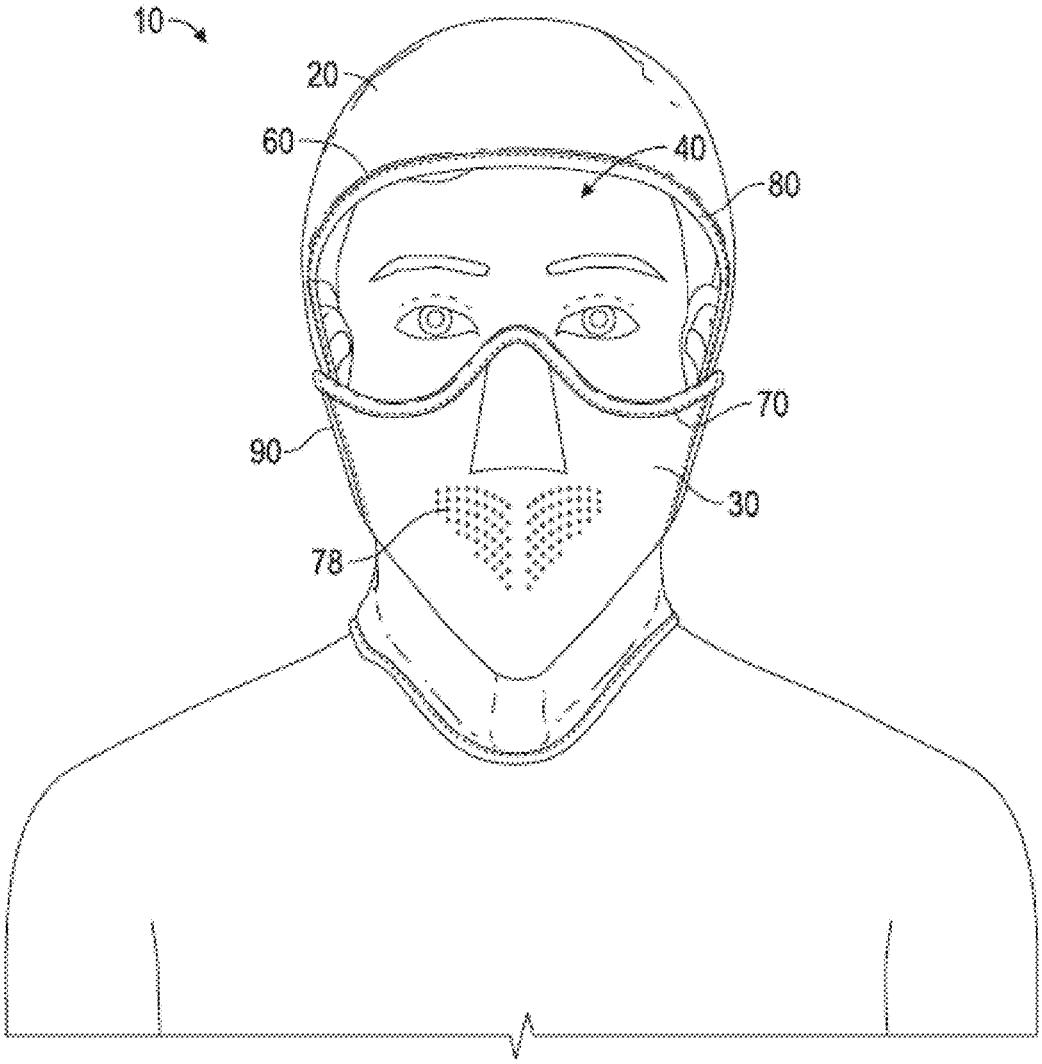
FIG. 1A is a front view diagram illustrating an example head garment having a base section and a face section according to an embodiment of the invention.

FIG. 1A is a front view diagram illustrating an example head garment 10 having a base section 20 and a face section 30 according to an embodiment of the invention. The base section 20 may be made up of a single piece of material or a plurality of pieces of material. In the illustrated embodiment, the base section 20 is in the form of a hood, but alternate forms may also be employed as will be understood by skilled artisans, for example the base section 20 may eliminate the hood and thereby not cover the top portion of the head. The face section 30 may also be made up of a single piece of material or a plurality of pieces of material. In an alternative embodiment, both the base section 20 and the face section 30 may be made up of a single piece of material such that connection 50 (not shown) does not affix the base section 20 material to the face section 30 material, but is instead a continuation of a single piece of material.

The base section 20 has an internal base perimeter 60. The base perimeter 60 defines an enclosed face opening 40. The base perimeter 60 has an upper forehead portion and a lower chin portion. Attached to at least a lower portion of the base perimeter 60 is a base piping 80. In one embodiment, base piping 80 is attached to and extends along one or more segments of the lower portion of the base perimeter 60. Base piping 80 defines a base elongated cavity 82 (not shown). In one embodiment, where connection 50 (not shown) is situated near the chin of the user, there are two separate segments of base piping 80 that each extend along a lower portion of the base perimeter 60 and are separated by connection 50 (not shown). In an alternative embodiment, where connection 50 (not shown) is situated near one cheek of the user, there is a single segment of base piping 80 that extends along a lower portion of the base perimeter 60. The base section 20 may be made from any of a variety of materials including: fleece, fabric, neoprene, polymer, laminates and membranes such as rubber and elastomer, etc.

The face perimeter 70 is patterned to conform to the shape of the lower portion of the base perimeter 60 when the head garment 10 is worn by a user. The face section 30 includes a face perimeter 70, a portion of which is affixed to the base section 20, for example by connection 50 (not shown), which may be affixed by stitching, snaps, hook and loop, buttons, zippers and the like. The face perimeter 70 has an upper nose portion and a lower chin portion. When the face section 30 is magnetically sealed in place, an upper portion of the face perimeter 70 extends across the face of the user, for example across a first cheek and over the bridge of the nose and across a second cheek. The face section 30 may include a cut out 76 to accommodate the nose of the user and the face section 30 may also include one or more through holes 78 disposed over the mouth of the user when the face section 30 is magnetically sealed in place.

In one embodiment, face piping 90 is attached to and extends along at least a lower portion of the face perimeter 70. Face piping 90 defines a face elongated cavity 92 (not shown). In one embodiment, where connection 50 (not shown) is situated near the chin of the user, there are two separate segments of face piping 90 that each extend along a lower portion of the face perimeter 70 and are separated by connection 50 (not shown). In an alternative embodiment, where connection 50 (not shown) is situated near one cheek of the use, there is a single segment of face piping 70 that extends along a portion of the face lower perimeter 72. The face section 30 may be made from any of a variety of materials including: fleece, fabric, neoprene, polymer, plastic, laminates and membranes such as rubber and elastomer, etc.

Figure 1B:
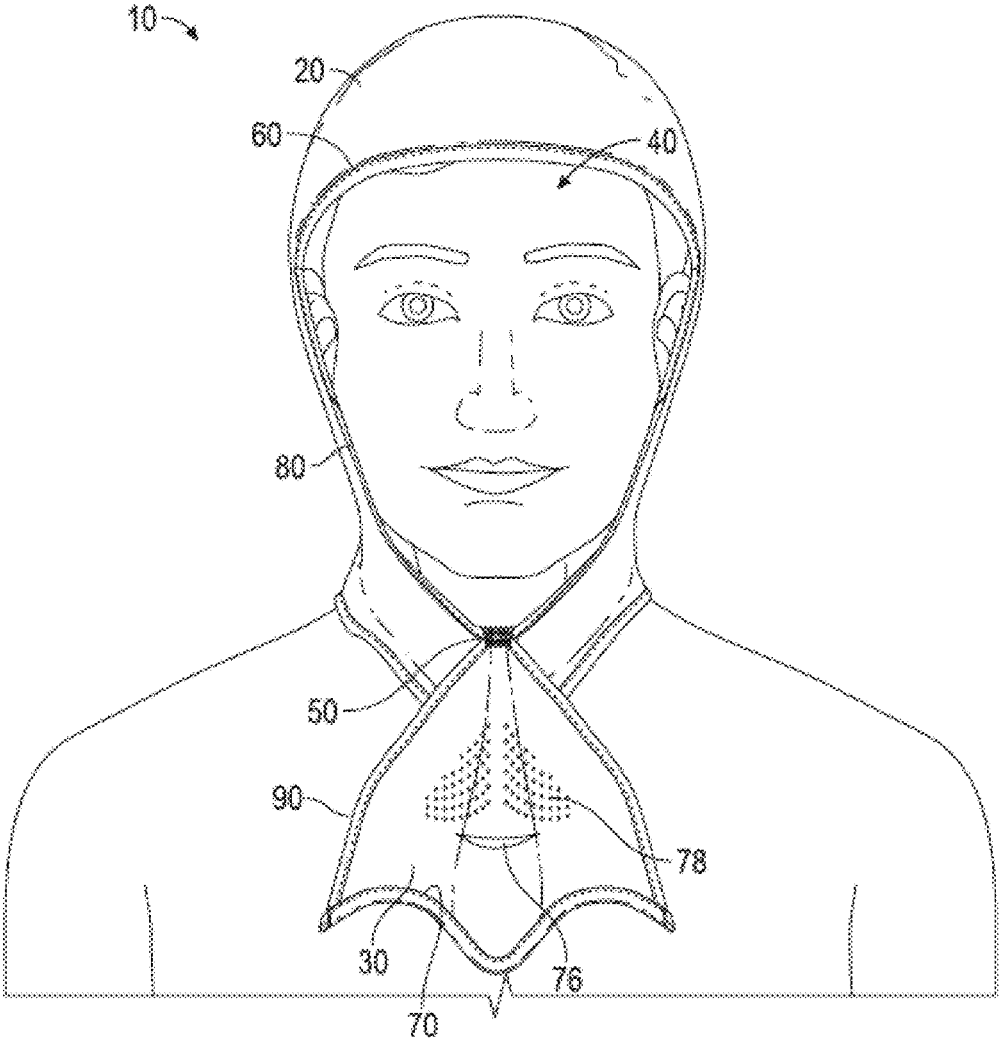
FIG. 1B is a front view diagram of the example head garment of FIG. 1A illustrating a detached face section according to an embodiment of the invention.

FIG. 1B is a front view diagram of the example head garment 10 of FIG. 1A illustrating a magnetically detached face section 30 according to an embodiment of the invention. In the illustrated embodiment, the face section 30 is not sealed across the face of the user, but the face section 30 remains attached to the base section 20 by way of connection 50, which is situated near the chin of the user. Advantageously, the face section 30 may be detached as shown to allow for cooling of the face and head of the user and to facilitate ease of verbal communication by the user while also remaining integral to the head garment 10.

Figure 1C:
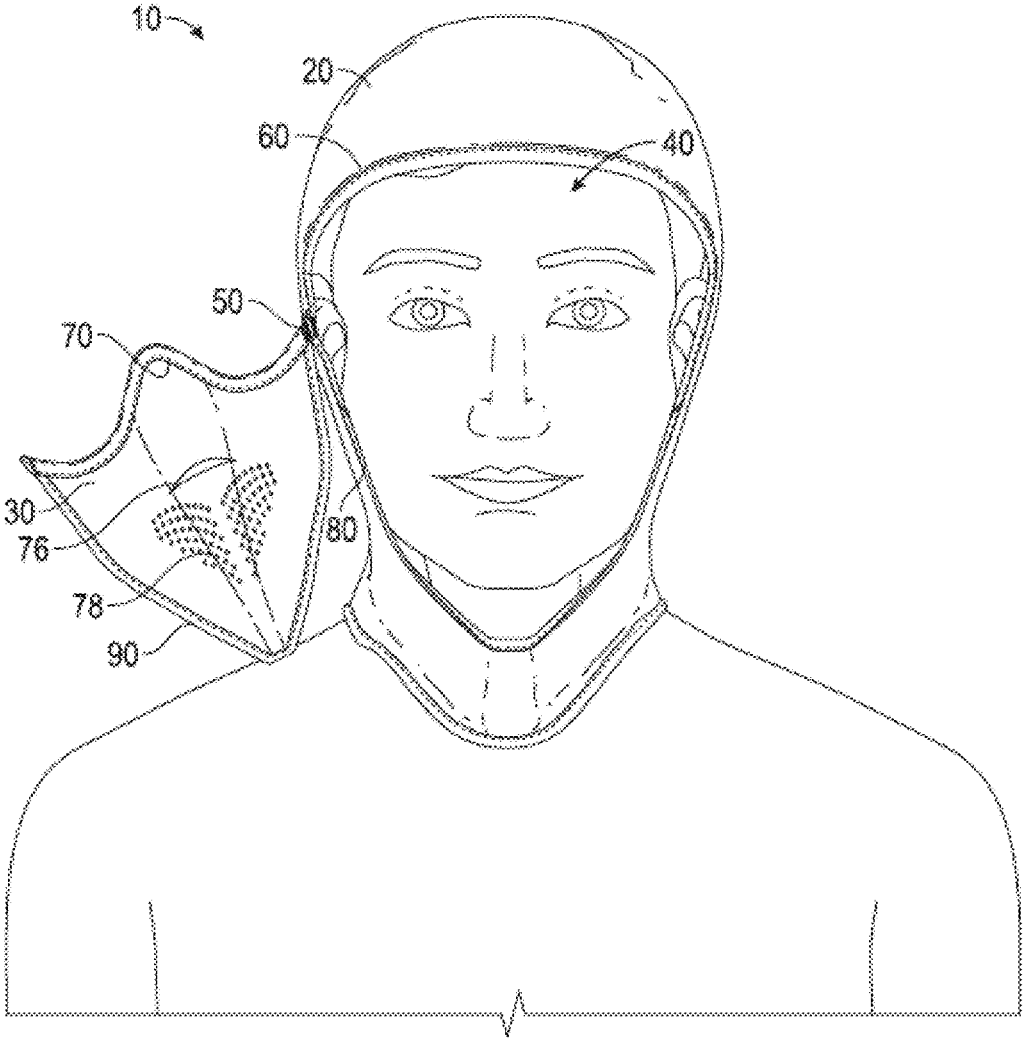
FIG. 1C is a front view diagram of the example head garment of FIG. 1A illustrating a detached face section according to an alternative embodiment of the invention.

FIG. 1C is a front view diagram of the example head garment 10 of FIG. 1A illustrating a detached face section 30 according to an alternative embodiment of the invention. In the illustrated embodiment, the face section 30 is not sealed across the face of the user, but the face section 30 remains attached to the base section 20 by way of connection 50, which is situated near a cheek of the user. Advantageously, the face section 30 may be detached as shown to allow for cooling of the face and head of the user and to facilitate ease of verbal communication by the user while also remaining integral to the head garment 10.

Figure 2A:
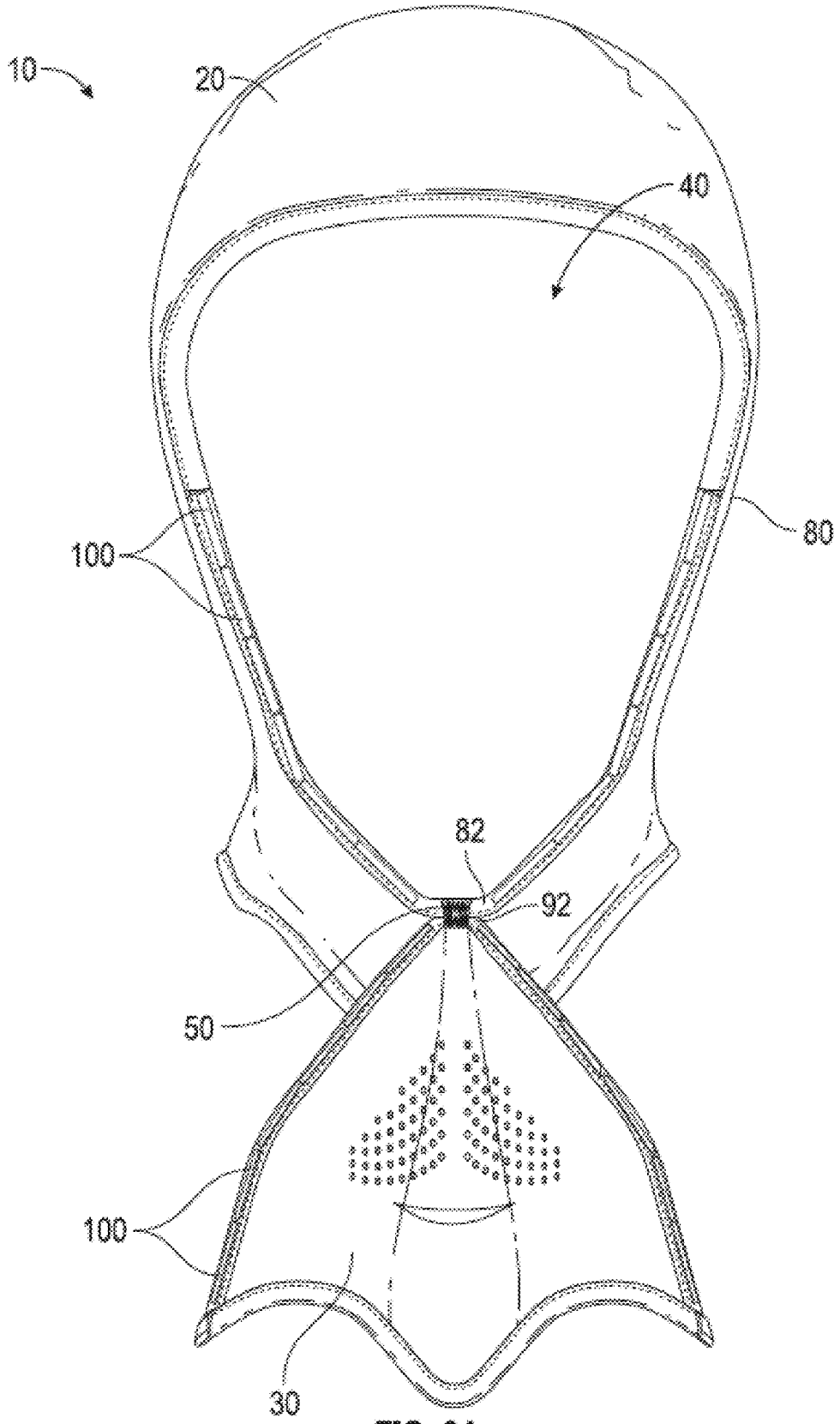
FIG. 2A is an expanded front view diagram of the example head garment of FIG. 1A illustrating an example magnet arrangement in the base piping and face piping according to an embodiment of the invention.

FIG. 2A is an expanded front view diagram of the example head garment 10 of FIG. 1A illustrating an example magnet 100 arrangement in the base piping 80 and face piping 90 according to an embodiment of the invention. In the illustrated embodiment, a plurality of magnets 100 are positioned in the base elongated cavity 82 defined by the base piping 80. Additionally, a plurality of magnets 100 are positioned in the face elongated cavity 92 defined by the face piping 90. The magnets 100 positioned in the base elongated cavity 82 have corresponding magnets 100 positioned in the face elongated cavity 92. Each magnet 100 positioned in the base elongated cavity 82 has a north or south magnetic pole facing its corresponding magnet 100 positioned in the face elongated cavity 92, which in turn has an opposite north or south magnetic pole facing the corresponding magnet 100 positioned in the base elongated cavity 82. Accordingly, when the face section 30 is brought into proximity with the base section 20, each magnet 100 in the base elongated cavity 82 is attracted to its corresponding magnet 100 in the face elongated cavity 92 and the resulting magnetic pairing seals the face section 30 to the base section 20.

In an alternative embodiment, a single magnet 100 is positioned in the base elongated cavity 82 defined by the base piping 80. Additionally, a single magnet 100 is positioned in the face elongated cavity 92 defined by the face piping 90. Accordingly, each single magnet 100 in the base elongated cavity 82 and the face elongated cavity 92 extends substantially from a first end of its respective cavity (82, 92) to a second end of its respective cavity (82, 92). Thus, the single magnet 100 positioned in the base elongated cavity 82 has a corresponding magnet 100 positioned in the face elongated cavity 92. Also, the single magnet 100 positioned in the base elongated cavity 82 has a north or south magnetic pole facing its corresponding magnet 100 positioned in the face elongated cavity 92, which in turn has an opposite north or south magnetic pole facing the corresponding magnet 100 positioned in the base elongated cavity 82. Accordingly, when the face section 30 is brought into proximity with the base section 20, the single magnet 100 in the base elongated cavity 82 is attracted to its corresponding single magnet 100 in the face elongated cavity 92 and the resulting magnetic pairing seals the face section 30 to the base section 20.

Additionally, each magnet 100 inside the base elongated cavity 82 and the face elongated cavity 92 is magnetically attracted along one of its short edges to the closest short edge of its adjacent magnet 100 (or magnets 100 in the case of an interior magnet 100). This internal short edge magnetic attraction within each elongated cavity (82, 92) advantageously creates a segmented and malleable magnetically sealed barrier within each elongated cavity (82, 92) and therefore along at least a lower portion of the base perimeter 60 and along at least a lower portion of the face perimeter 70.

In an alternative embodiment, a single elongated magnet 100 may fill the same space within the base piping 80 as the plurality of magnets 100 previously described. Similarly, a single elongated magnet 100 may also fill the same space within the face piping 90 as the plurality of magnets 100 previously described. In such an embodiment, the single elongated magnet 100 may be formed by extrusion in order to conform the shape of the single elongated magnet 100 to any curves of the base piping 80 or the face piping 90. In such an embodiment, the single elongated magnet 100 in the base piping 80 may be made of a magnetic material having a single pole that is attracted to the single elongated magnet 100 in the face piping 90 that is made of a magnetic material having the opposite pole. Alternatively, the single elongated magnets 100 may comprise both magnetic poles arranged in a variety of fashions to facility alignment and magnetic attraction between the single elongated magnet 100 in the base piping 80 and the single elongated magnet 100 in the face piping 90.

Additionally, in one embodiment an elongated magnet 100 may be attached directly to the base perimeter 60 and eliminate the need for the base piping 80. Similarly, an elongated magnet 100 may be attached directly to the face perimeter 70 and eliminate the need for the face piping 90. In such an embodiment, the elongated magnet 100 can be attached by way of stitching, welding, adhesive or the like. Additionally, the elongated magnet 100 attached directly to the base perimeter 60 and the elongated magnet 100 attached directly to the face perimeter 70 are magnetically attracted to each other and the resulting magnetic pairing seals the face section 30 to the base section 20.

Additionally, in alternative embodiments, the base piping 80 may include one or more magnets 100 while the corresponding face piping 90 may include one or more segments (not shown) comprising a metal to which the magnets are attracted. Alternatively, the face piping 90 may include one or more magnets 100 while the corresponding base piping 80 may include one or more segments (not shown) comprising a metal to which the magnets are attracted. In these alternative embodiments, magnets are only include in one piping while the corresponding piping includes metal to which the magnets are attracted.

Figure 2B:
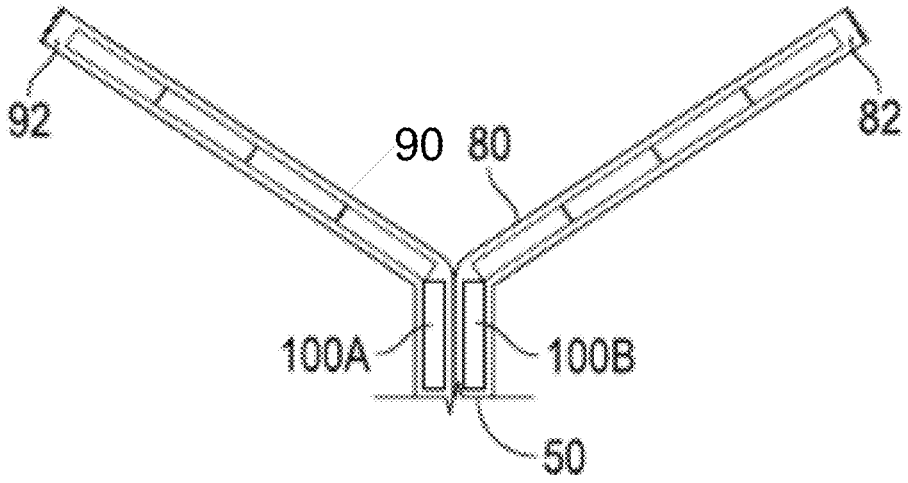
FIG. 2B is an expanded front view diagram of the example head garment of FIG. 1A illustrating an example magnetic seal between the base piping and face piping according to an embodiment of the invention.

FIG. 2B is an expanded front view diagram of the example head garment 10 of FIG. 1A illustrating an example magnetic seal between the base piping 80 and face piping 90 according to an embodiment of the invention. In the illustrated embodiment, a plurality of magnets 100 are positioned in the base elongated cavity 82, specifically including magnet 100B as shown. Additionally, a plurality of magnets 100 are also positioned in the face elongated cavity 92, specifically including magnet 100A as shown. When the face piping 90 is brought into proximity with the base piping 80, magnet 100B in the face elongated cavity 92 is attracted to magnet 100A in the base elongated cavity 82 and the resulting magnetic pairing between magnet 100A and magnet 100B seals a portion of the face piping 90 to its corresponding portion of the base piping 80.

Figure 2C:
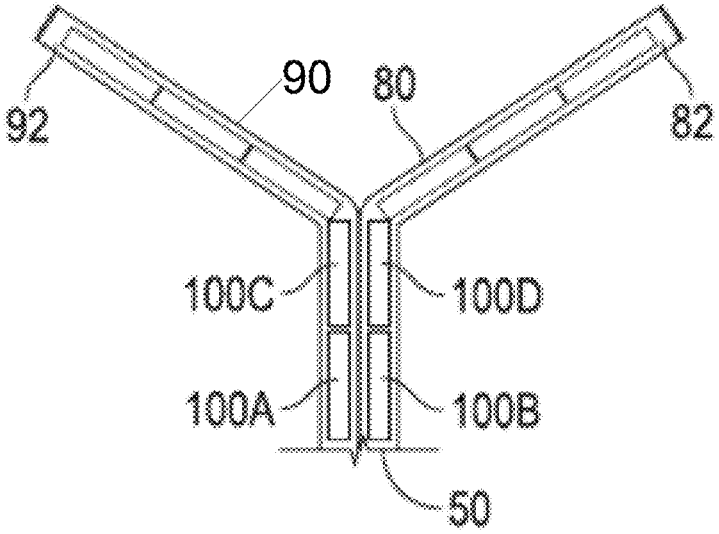
FIG. 2C is an expanded front view diagram of the example head garment of FIG. 1A illustrating an example magnetic seal between the base piping and face piping according to an embodiment of the invention.

FIG. 2C is an expanded front view diagram of the example head garment 10 of FIG. 1A illustrating an example magnetic seal between the base piping 80 and face piping 90 according to an embodiment of the invention. In the illustrated embodiment, a plurality of magnets 100 are positioned in the base elongated cavity 82, specifically including magnets 100B and 100D as shown. Additionally, a plurality of magnets 100 are also positioned in the face elongated cavity 92, specifically including magnets 100A and 100C as shown. When the face piping 90 is brought into proximity with the base piping 80, magnet 100A in the face elongated cavity 92 is attracted to magnet 100B in the base elongated cavity 82 and magnet 100C in the face elongated cavity 92 is attracted to magnet 100D in the base elongated cavity 82. Additionally, magnets 100A and 100C are attracted to each other on their adjacent short edges and magnets 100B and 100D are attracted to each other on their adjacent short edge. The combination of the resulting magnetic pairings between magnets 100A, 100B, 100C and 100D creates a segmented and malleable magnetic barrier that seals a portion of the face piping 90 to its corresponding portion of the base piping 80 and forms a portion of the seal between the face section 30 and the base section 20 of the head garment 10. Advantageously, the magnetic seal presses the face piping 90 to the base piping 80 to create an element resistant seal between the face section 30 and the base section 20.

Figure 3A:
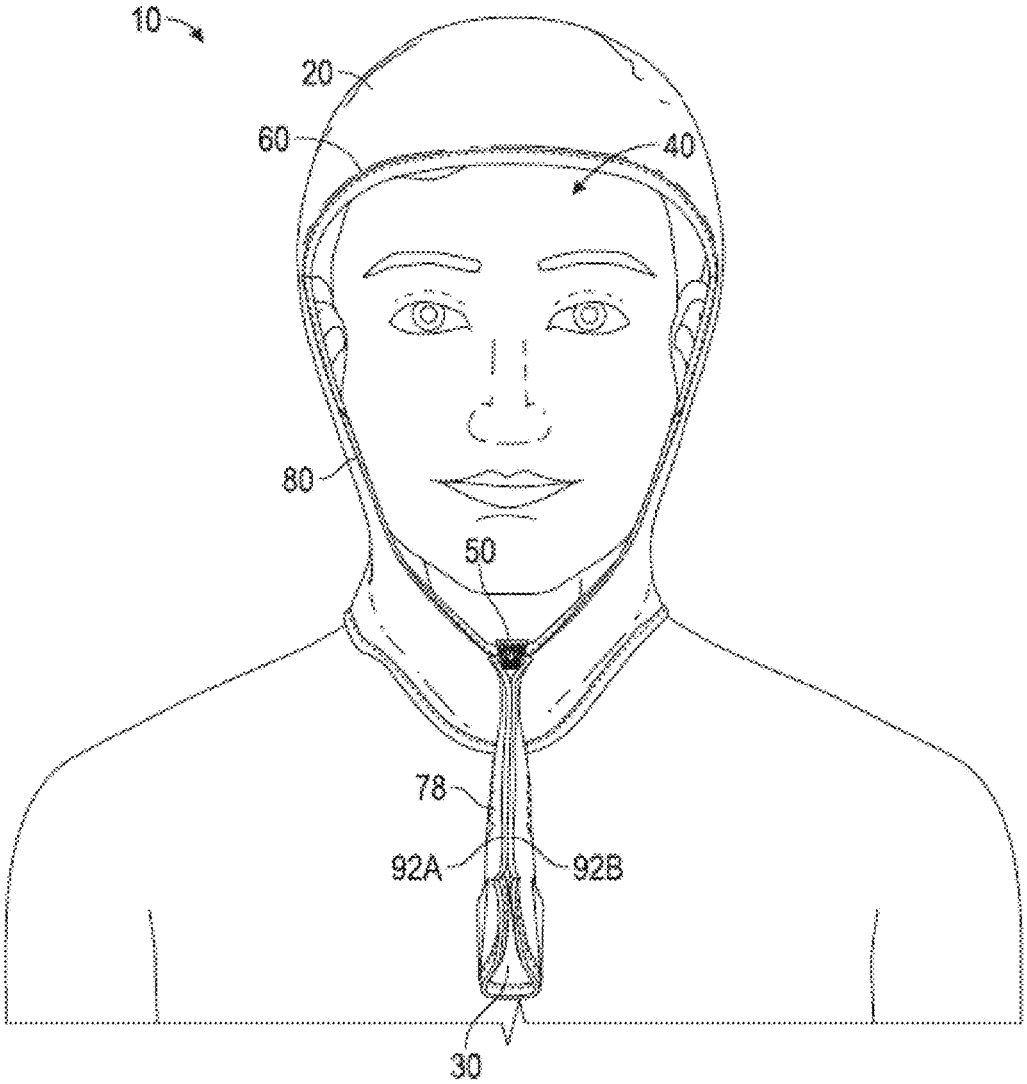
FIG. 3A is a front view diagram of the example head garment of FIG. 1A illustrating an example detached face section according to an embodiment of the invention.

FIG. 3A is a front view diagram of the example head garment 10 of FIG. 1A illustrating an example detached face section 30 according to an embodiment of the invention. In the illustrated embodiment, the face section 30 is attached to the base section 20 via connection 50 that is situated near the chin of the user. When the face section 30 is detached, each of the plurality of magnets 100 within a first segment of face elongated cavity 92A is magnetically attracted along its long edge to a corresponding pair magnet 100 within a second segment of face elongated cavity 92B. Advantageously, this pairing of magnets within the segments of the face elongated cavity 92 that are separated by connection 50 allows the face section 30 to be magnetically secured out of the way in its detached state.

Figure 3B:
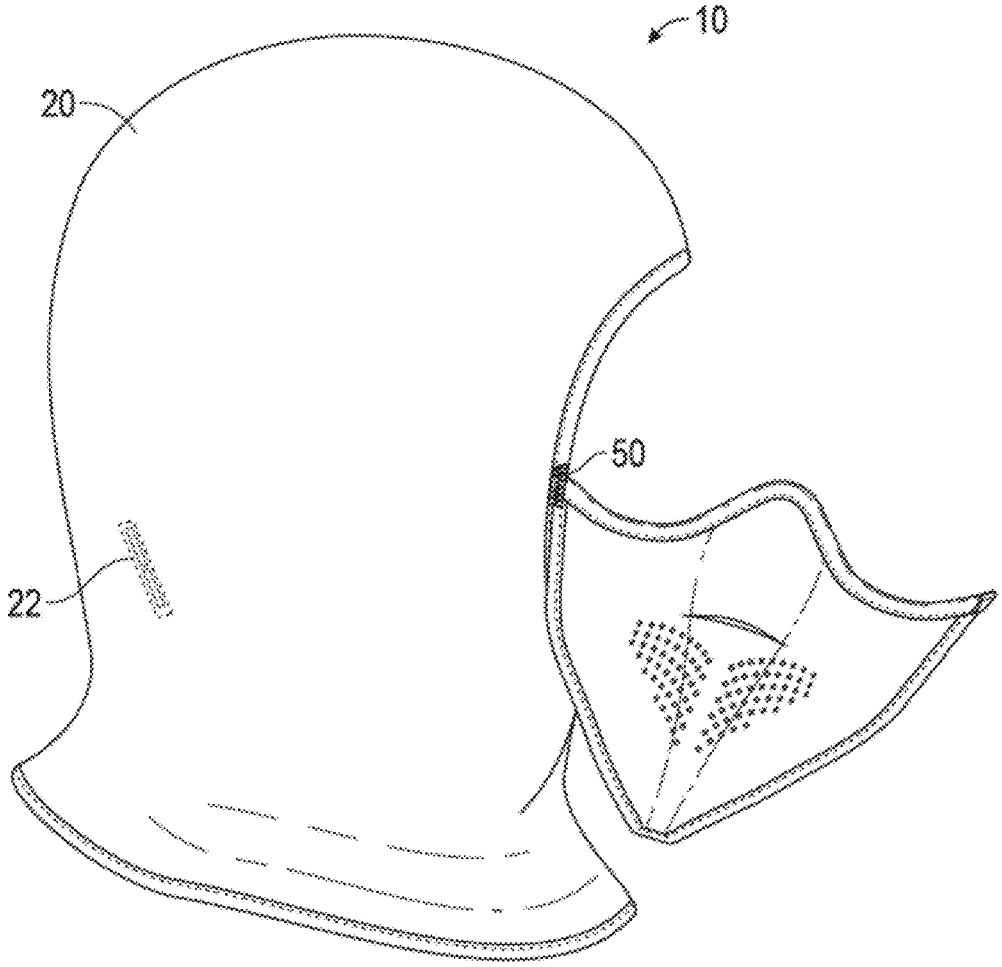
FIG. 3B is a side view diagram of the example head garment of FIG. 1A illustrating an example magnetic fastener in the base section according to an alternative embodiment of the invention.

FIG. 3B is a side view diagram of the example head garment 10 of FIG. 1A illustrating an example magnetic fastener 22 in the base section 20 according to an alternative embodiment of the invention. In alternative embodiments, the fastener 22 may comprise one or more magnets 100 attached to base section 20 or alternatively positioned between two layers of base section 20 (in an embodiment where base section 20 includes two or more layers). The fastener 22 may include a piping 24 within which the one or more magnets 100 are housed and in such an embodiment, the piping can be secured to the base section for example by stitching (not shown).

Advantageously, when the face section 30 is detached and extended along the side of the base section 20 toward the back of the head of the user, one or more of the plurality of magnets 100 within the face elongated cavity 92 is magnetically attracted along its long edge to the long edge of corresponding one or more magnets 100 of the fastener 22. Accordingly, the magnetic pairing of one or more magnets 100 in the face elongated cavity 92 with the one or more magnets 100 in the fastener 22 allows the face section 30 to be magnetically secured out of the way in its detached state.

Figure 3C:
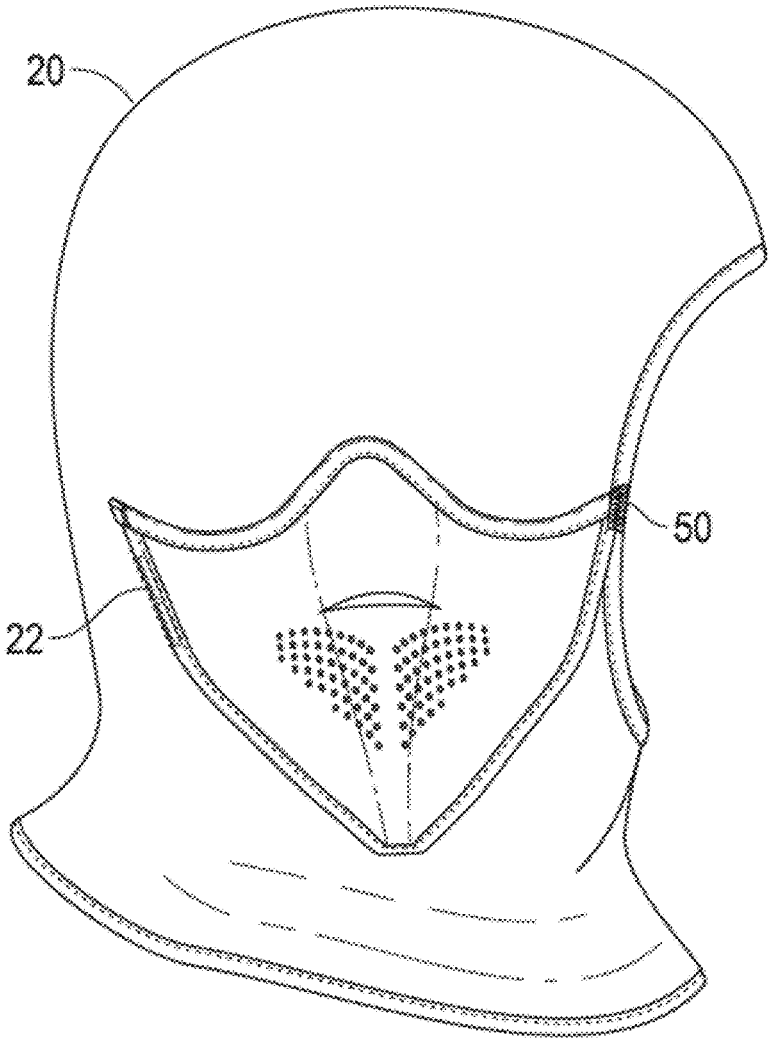
FIG. 3C is a side view diagram of the example head garment of FIG. 1A illustrating an example face section magnetically fastened to the base section according to an alternative embodiment of the invention.

FIG. 3C is a side view diagram of the example head garment 10 of FIG. 1A illustrating an example face section 30 magnetically fastened to the base section 20 according to an alternative embodiment of the invention. In the illustrated embodiment, one or more magnets 100 in the face elongated cavity 92 are magnetically fastened to one or more magnets 100 in the fastener 22 to magnetically secure the face section 30 out of the way in its detached state.

Figure 4A:
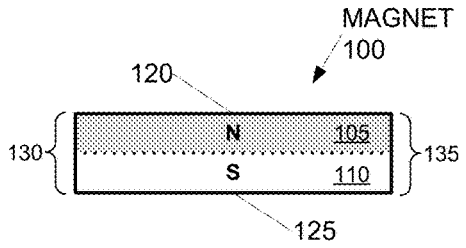
FIG. 4A is a block diagram illustrating an example magnet according to an embodiment of the invention.

FIG. 4A is a block diagram illustrating an example magnet 100 according to an embodiment of the invention. In one embodiment, magnet 100 has an elongated shape and may have a generally cuboidal or cylindrical or polygonal three dimensional shape. The edges of magnet 100 may be squared or rounded. The length of magnet 100 is substantially greater than the width of the base elongated cavity 82 and face elongated cavity 92, each of which have roughly the same width. The purpose of the length of the magnet 100 is to prevent the magnet 100 from any X-Y-Z positional rotation within the base elongated cavity 82 or face elongated cavity 92. Maintaining the proper X-Y-Z orientation of the magnet 100 within the piping is critical because when the face section 30 is sealed to the base section 20, each interior magnet 100 within the base elongated cavity 82 and face elongated cavity 92 is magnetically attached to a corresponding magnet 100 on three sides (i.e., one long edge and two short edges). Also, when the face section 30 is sealed to the base section 20, each end magnet 100 within the base elongated cavity 82 and face elongated cavity 92 is magnetically attached to a corresponding magnet 100 on two sides (i.e., one long edge and one short edge).

An additional purpose of the length of the magnet 100 is to allow the base perimeter 60 and the face perimeter 70 to curve along the contours of the head garment 10 and the face of the user. Accordingly, the length of the magnet 100 must be both long enough to prevent X-Y-Z positional rotation within the piping but short enough to allow the piping to curve along the contours of the head garment 10 and the face of the user. In one embodiment, the length of each magnet 100 is approximately two centimeters (2 cm) and may alternatively be within a range of approximately one centimeter (1 cm) to three centimeters (3 cm).

In the illustrated embodiment, the magnet 100 comprises a magnetic north pole portion 105 and a magnetic south pole portion 110. The magnetic north pole portion 105 and magnetic south pole portion 110 each comprise roughly half of the material of the magnet 100. The magnet 100 has two long edges 120, 125 and two short edges 130, 135. The magnetic north pole portion 105 extends along the entire length of long edge 120 and a portion of the length of each of the two short edges 130, 135. The magnetic south pole portion 110 extends along the entire length of long edge 135 and a portion of the length of each of the two short edges 130, 135.

Figure 4B:
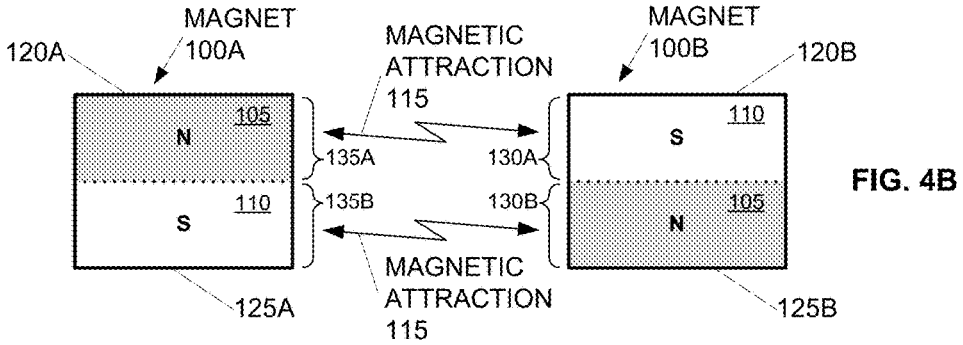
FIG. 4B is a block diagram illustrating an example arrangement of magnets in the base piping or the face piping according to an embodiment of the invention.

FIG. 4B is a block diagram illustrating an example arrangement of magnets 100A and 100B in the base piping 80 or the face piping 90 according to an embodiment of the invention. In the illustrated embodiment, magnet 100A includes a magnetic north pole section 135A on a first short edge and a magnetic south pole section 135B on the same first short edge. Similarly, magnet 100B includes a magnetic north south pole section 130A on a first short edge and a magnetic south pole section 130B on the same first short edge. When the short edges of magnet 100A and magnet 100B come into proximity with each other, they are only attracted to each other when long edges 120A and 1206 are generally parallel or facing the same direction and when long edges 125A and 125B are also generally parallel or facing the same direction. Accordingly, the magnets 100 are specifically oriented within the piping so that each magnet 100 is magnetically attracted to its adjacent neighbors and in combination the magnets 100 within a single piping form a malleable magnetic barrier capable of bending while remaining magnetically connected to each other within the piping.

Figure 4C:
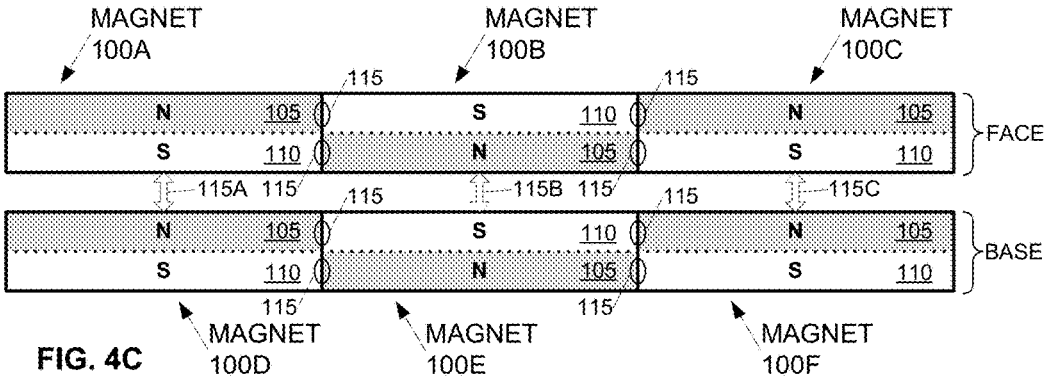
FIG. 4C is a block diagram illustrating an example arrangement of magnets in the base piping and the piping section according to an embodiment of the invention.

FIG. 4C is a block diagram illustrating an example arrangement of magnets 100A, 100B and 100C the face piping 90 and magnets 100D, 100E and 100F in the base piping 80 and according to an embodiment of the invention. In the illustrated embodiment, magnet 100A is connected to magnet 100B along respective short edges and magnet 1006 is connected to magnet 100C along respective short edges. Magnets 100A, 100B and 100C are positioned in the face elongated cavity 92 in the face piping 90. Similarly, magnet 100D is connected to magnet 100E along respective short edges and magnet 100E is connected to magnet 100F along respective short edges. Magnets 100D, 100E and 100F are positioned in the base elongated cavity 82 in the base piping 80.

When the face piping 90 comes into proximity of the base piping 80, magnet 100A and magnet 100D are magnetically attracted to each other along respective long edges by way of magnetic attraction 115A and magnet 100B and magnet 100E are magnetically attracted to each other along respective long edges by way of magnetic attraction 115B and magnet 100C and magnet 100F are magnetically attracted to each other along respective long edges by way of magnetic attraction 115C.

Figure 4D:
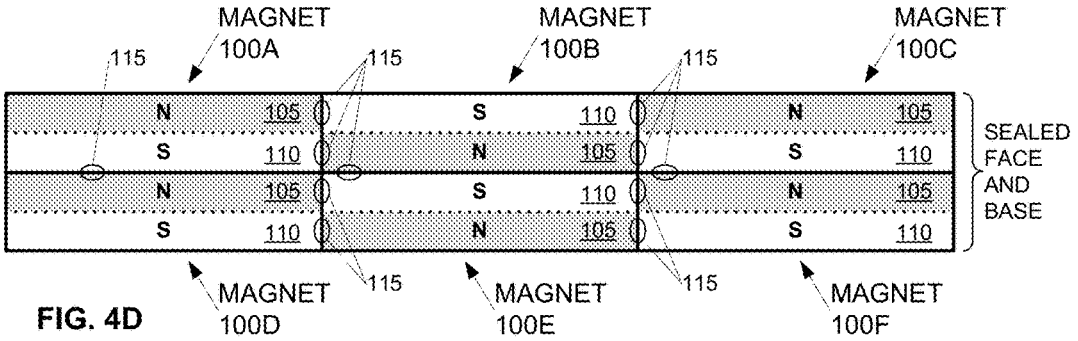
FIG. 4D is a block diagram illustrating an example arrangement of magnets when the base section and the face section are sealed according to an embodiment of the invention.

FIG. 4D is a block diagram illustrating an example arrangement of magnets 100A, 100B and 100C in the face piping 90 and magnets 100D, 100E and 100F in the base piping 80 when the base section 20 and the face section 30 are sealed according to an embodiment of the invention. In the illustrated embodiment, magnetic attractions 115 along the short edges of each of the magnets within the face piping 90 connect each magnet to its adjacent magnet within the face piping 90. Similarly, magnetic attractions 115 along the short edges of each of the magnets within the base piping 80 connect each magnet to its adjacent magnet within the base piping 80.

Moreover, magnetic attraction 115 along adjacent long edges of magnets 100A and 100D form a portion of the seal between the face section 30 and the base section 20. Additionally, magnetic attraction 115 along adjacent long edges of magnets 100B and 100E and magnets 100C and 100F also form a portion of the seal between the face section 30 and the base section 20. In combination, the magnetic seal between the individual magnets within a piping and the magnetic seal between corresponding magnets of the face piping 90 and the base piping 80 form an overall magnetic seal between the face section 30 and the base section 20 that allows the face section 30 to be detached from and re-attached to the base section 20 and when attached, the seal prevents wind and rain and cold elements from penetrating the head garment 10 at the connection between the base section 20 and the face section 30.

Advantageously, when the face section 20 is sealed to the base section 30, each interior magnet 100B and 100E is magnetically connected to another magnet on at least three different sides and has five independent magnetic attractions while each end magnet 100A, 100C, 100D, 100F is magnetically connected to another magnet on two different sides and has three independent magnetic attractions.

Figure 5A:
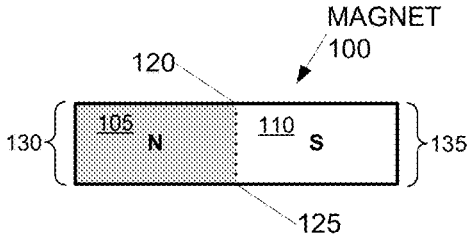
FIG. 5A is a block diagram illustrating an example magnet according to an alternative embodiment of the invention.

FIG. 5A is a block diagram illustrating an example magnet 100 according to an alternative embodiment of the invention. In one embodiment, magnet 100 has an elongated shape and may have a generally cuboidal or cylindrical three dimensional shape. The edges of magnet 100 may be squared or rounded. The length of magnet 100 is substantially greater than the width of the base elongated cavity 82 and face elongated cavity 92, each of which have roughly the same width. The purpose of the length of the magnet 100 is to prevent the magnet 100 from any X-Y-Z positional rotation within the base elongated cavity 82 or face elongated cavity 92. Maintaining the proper X-Y-Z orientation of the magnet 100 within the piping is critical because when the face section 30 is sealed to the base section 20, each interior magnet 100 within the base elongated cavity 82 and face elongated cavity 92 is magnetically attached to a corresponding magnet 100 on three sides (i.e., one long edge and two short edges). Also, when the face section 30 is sealed to the base section 20, each end magnet 100 within the base elongated cavity 82 and face elongated cavity 92 is magnetically attached to a corresponding magnet 100 on two sides (i.e., one long edge and one short edge). In an alternative embodiment, the magnets 100 can have any length and any width because the arrangement of and the attraction between the magnetic poles of the magnets 100 within the base elongated cavity 82 or face elongated cavity 92 prevent the magnet 100 from X-Y-Z positional rotation.

An additional purpose of the length of the magnet 100 is to allow the base perimeter 60 and the face perimeter 70 to curve along the contours of the head garment 10 and the face of the user. Accordingly, the length of the magnet 100 must be both long enough to prevent X-Y-Z positional rotation within the piping but short enough to allow the piping to curve along the contours of the head garment 10 and the face of the user. In one embodiment, the length of each magnet 100 is approximately two centimeters (2 cm) and may alternatively be within a range of approximately one centimeter (1 cm) to three centimeters (3 cm).

In the illustrated embodiment, the magnet 100 comprises a magnetic north pole portion 105 and a magnetic south pole portion 110. The magnetic north pole portion 105 and magnetic south pole portion 110 each comprise roughly half of the material of the magnet 100. The magnet 100 has two long edges 120, 125 and two short edges 130, 135. The magnetic north pole portion 105 comprises approximately the entire half of the magnet 100 that includes short edge 130. The magnetic south pole portion 110 comprises approximately the entire other half of the magnet 100 that includes short edge 135.

Figure 5B:
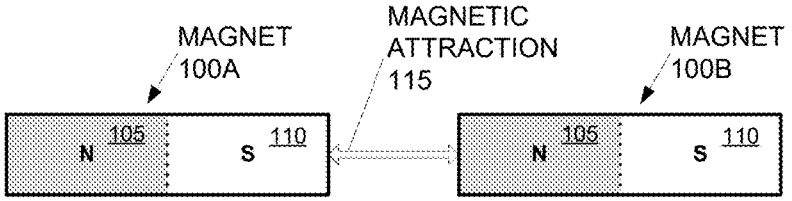
FIG. 5B is a block diagram illustrating an example arrangement of magnets in the base section or the face section according to an alternative embodiment of the invention.

FIG. 5B is a block diagram illustrating an example arrangement of magnets 100A and 100B in the base piping 80 or the face piping 90 according to an embodiment of the invention. In the illustrated embodiment, when magnetic south pole portion 110 of magnet 100A comes into proximity with magnetic north pole portion 105 of magnet 100B, magnetic attraction 115 attracts to two magnets to each other. Accordingly, the magnets 100A and 100B are specifically positioned within the piping so that magnet 100A is magnetically attracted to its adjacent neighbors (e.g., magnet 100B) and in combination the magnets 100 within a single piping form a malleable magnetic barrier capable of bending while remaining magnetically connected to each other within the piping.

Figure 5C:
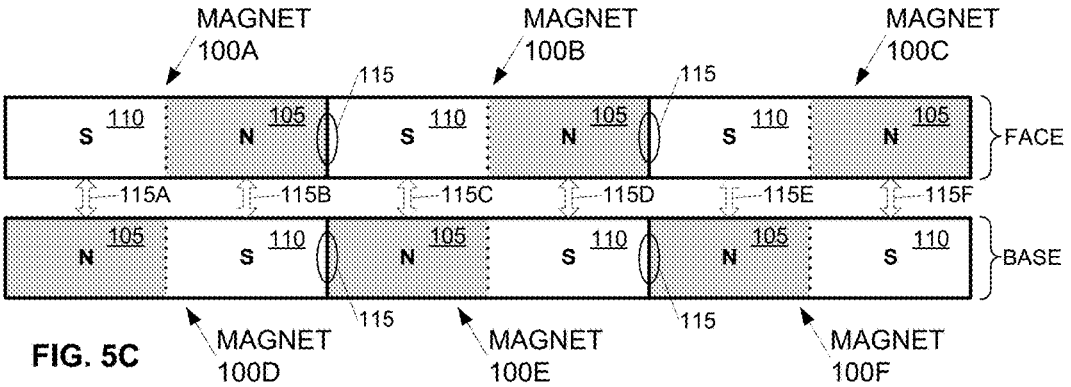
FIG. 5C is a block diagram illustrating an example arrangement of magnets in the base section and the face section according to an alternative embodiment of the invention.

FIG. 5C is a block diagram illustrating an example arrangement of magnets 100A, 100B and 100C the face piping 90 and magnets 100D, 100E and 100F in the base piping 80 and according to an embodiment of the invention. In the illustrated embodiment, magnet 100A is connected to magnet 100B along respective short edges and magnet 1006 is connected to magnet 100C along respective short edges. Magnets 100A, 100B and 100C are positioned in the face elongated cavity 92 in the face piping 90. Similarly, magnet 100D is connected to magnet 100E along respective short edges and magnet 100E is connected to magnet 100F along respective short edges. Magnets 100D, 100E and 100F are positioned in the base elongated cavity 82 in the base piping 80.

When the face piping 90 comes into proximity with the base piping 80, the north pole portion 105 and the south pole portion 110 of a long edge of magnet 100A are each magnetically attracted to the opposite and therefore magnetically corresponding south pole portion 110 and north pole portion 105 of a long edge of magnet 100D by way of magnetic attractions 115A and 1156. Similarly the north pole portion 105 and the south pole portion 110 of a long edge of magnets 1006 and 100C are each magnetically attracted to the opposite and therefore magnetically corresponding south pole portion 110 and north pole portion 105 of a long edge of magnets 100E and 100F by way of magnetic attractions 115C, 115D, 115E and 115F.

Figure 5D:
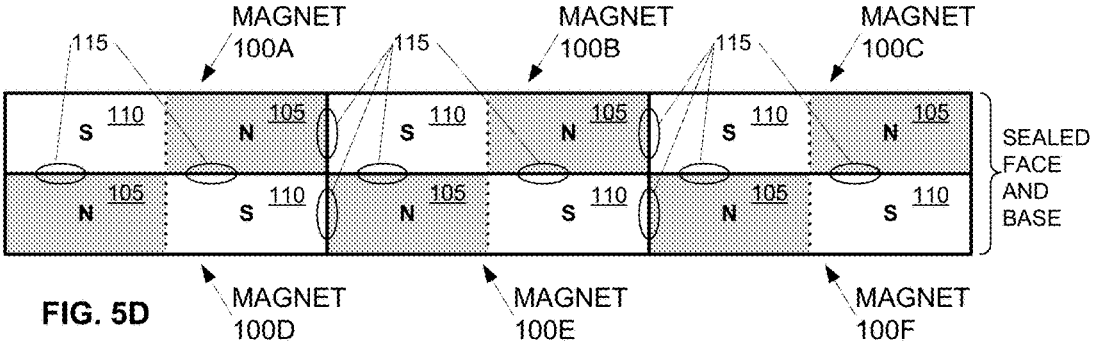
FIG. 5D is a block diagram illustrating an example arrangement of magnets when the base section and the face section are sealed according to an alternative embodiment of the invention.

FIG. 5D is a block diagram illustrating an example arrangement of magnets 100A, 100B and 100C in the face piping 90 and magnets 100D, 100E and 100F in the base piping 80 when the base section 20 and the face section 30 are sealed according to an embodiment of the invention. In the illustrated embodiment, magnetic attractions 115 along the short edges of each of the magnets within the face piping 90 connect each magnet to its adjacent magnet within the face piping 90. Similarly, magnetic attractions 115 along the short edges of each of the magnets within the base piping 80 connect each magnet to its adjacent magnet within the base piping 80.

Moreover, dual magnetic attractions 115 along two portions of adjacent long edges of magnets 100A and 100D form a portion of the seal between the face section 30 and the base section 20. Additionally, magnetic attractions 115 along two portions of adjacent long edges of magnets 100B and 100E and magnets 100C and 100F also form a portion of the seal between the face section 30 and the base section 20. In combination, the magnetic seal between the individual magnets within a piping and the magnetic seal between corresponding magnets of the face piping 90 and the base piping 80 form an overall magnetic seal between the face section 30 and the base section 20 that allows the face section 30 to be detached from and re-attached to the base section 20 and when attached, the seal prevents wind and rain and cold elements from penetrating the head garment 10 at the connection between the base section 20 and the face section 30.

Advantageously, when the face section 20 is sealed to the base section 30, each interior magnet 100B and 100E is magnetically connected to another magnet on at least three different sides and has four independent magnetic attractions while each end magnet 100A, 100C, 100D, 100F is magnetically connected to another magnet on two different sides and has three independent magnetic attractions.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. A head garment comprising:

a base section defining an enclosed face opening having a base perimeter, the base perimeter having an upper portion and a lower portion;

a base piping attached to and extending along at least a portion of the base perimeter, the base piping defining a base elongated cavity;

a face section having a face perimeter, the face perimeter having an upper nose portion and a lower portion, wherein the face section comprises a cutout to accommodate a nose and one or more through holes positioned to be disposed over a mouth when worn;

a face piping attached to and extending along at least a portion of the face perimeter, the face piping defining a face elongated cavity;

at least one first elongated magnet oriented inside the base elongated cavity, said at least one first elongated magnet having a length and a width, wherein the length is longer than a width of the base elongated cavity;

at least one first elongated attractive segment magnetically attracted to the at least one first elongated magnet and oriented inside the face elongated cavity, said at least one first elongated attractive segment having a length and a width, wherein the length is longer than a width of the face elongated cavity;

wherein a first surface of the at least one first elongated magnet in the base elongated cavity comprises two long edges and two short edges and a first magnetic pole extending along the entire first surface, and wherein a second surface, opposite the first surface, of the at least one first elongated magnet comprises two long edges and two short edges and a second magnetic pole extending along the entire second surface, wherein the first and second magnetic pole portions are opposite poles, and wherein each of the at least one first elongated magnet in the base elongated cavity is configured to magnetically attach to a corresponding one of the at least one first elongated attractive segment in the face elongated cavity to extend the face section over at least a portion of the face opening and magnetically seal the face section to the base section.

2. The head garment of claim 1, wherein the at least one first elongated magnet in the base elongated cavity comprises two end magnets and a plurality of internal magnets.

3. The head garment of claim 2, wherein, when the face section is magnetically sealed to the base section, each internal magnet is positioned such that it is magnetically attached to another magnet in the first elongated magnet along two short edges and magnetically attached to a corresponding one of the at least one first elongated attractive segment along one long edge, and each end magnet is magnetically attached to another magnet in the first elongated magnet along only one short edge and magnetically attached to a corresponding one of the at least one first elongated attractive segment along one long edge.

4. The head garment of claim 1, wherein the plurality of second elongated magnets in the face elongated cavity comprises two end magnets and a plurality of internal magnets.

5. The head garment of claim 4, wherein, when the face section is sealed to the base section, each internal magnet is positioned such that it is magnetically attached to another magnet in the first elongated magnet along two short edges and magnetically attached to a corresponding one of the at least one first elongated attractive segment along one long edge, and each end magnet is magnetically attached to another magnet in the first elongated magnet along only one short edge and magnetically attached to a corresponding one of the at least one first elongated attractive segment along one long edge.

6. The head garment of claim 1, wherein a portion of the base perimeter is affixed to a corresponding portion of the face perimeter.

7. The head garment of claim 6, wherein the portion of the base perimeter is affixed to the corresponding portion of the face perimeter by one of stitching, snaps, hook and loop, buttons or zippers.

8. The head garment of claim 6, wherein the affixed portion is positioned along the lower portion of the base perimeter.

9. The head garment of claim 8, wherein the affixed portion divides the base piping into a first base piping segment and a second base piping segment and further divides the face piping into a first face piping segment and a second face piping segment, wherein the at least one first magnet comprises a plurality of first magnets divided between the first base piping segment and the second base piping segment and the at least one second magnet comprises a plurality of second magnets divided between the first face piping segment and the second face piping segment.

* * * * *